US012686423B2

(12) United States Patent
Li et al.

(10) Patent No.: US 12,686,423 B2
(45) Date of Patent: Jul. 21, 2026

(54) SUBWAY VEHICLE ELECTRONIC RECORD SYSTEM BASED ON BLOCKCHAIN TECHNOLOGY

(71) Applicant: Beijing Subway Operation Co., Ltd. Technology Innovation Research Institute Branch, Beijing (CN)

(72) Inventors: Ming Li, Beijing (CN); Jiao Zhang, Beijing (CN); Yun Wei, Beijing (CN); Hongtao Zhu, Beijing (CN); Tingrui Cui, Beijing (CN); Minghui Ding, Beijing (CN); Fan Yang, Beijing (CN); Yu Zhang, Beijing (CN); Liyuan Zhao, Beijing (CN); Hao Guo, Beijing (CN)

(73) Assignee: Beijing Subway Operation Co., Ltd. Technology Innovation Research Institute Branch, Beijing (CN)

( * ) Notice: Subject to any disclaimer, the term of this patent is extended or adjusted under 35 U.S.C. 154(b) by 445 days.

(21) Appl. No.: 18/463,361

(22) Filed: Sep. 8, 2023

(65) Prior Publication Data

US 2025/0083722 A1 Mar. 13, 2025

(51) Int. Cl.
*B61L 27/70* (2022.01)
*B61L 25/02* (2006.01)

(52) U.S. Cl.
CPC ..... *B61L 27/70* (2022.01); *B61L 25/028* (2013.01)

(58) Field of Classification Search
CPC ..... B61L 27/70; B61L 25/028
See application file for complete search history.

(56) References Cited

U.S. PATENT DOCUMENTS

| | | | | |
|---|---|---|---|---|
| 2,251,230 | A * | 7/1941 | Ragsdale | B61B 13/10 191/35 |
| 10,441,494 | B2 * | 10/2019 | Kim | G01C 21/3641 |
| 11,055,703 | B2 * | 7/2021 | Kondo | H04L 63/123 |
| 2009/0228777 | A1 * | 9/2009 | Henry | G06F 16/40 707/999.005 |
| 2016/0328890 | A1 * | 11/2016 | Keane | G07C 5/008 |
| 2018/0374091 | A1 * | 12/2018 | Madisetti | G06Q 20/3825 |
| 2020/0184739 | A1 * | 6/2020 | Nathan | G06Q 10/20 |
| 2022/0044335 | A1 * | 2/2022 | Yin | G06Q 10/047 |
| 2025/0083722 | A1 * | 3/2025 | Li | G06Q 50/40 |

FOREIGN PATENT DOCUMENTS

| | | | | |
|---|---|---|---|---|
| CN | 104932487 | A * | 9/2015 | G05B 23/0213 |
| CN | 105844435 | A * | 8/2016 | G06Q 50/26 |
| CN | 110775105 | B * | 11/2021 | B61L 25/021 |
| CN | 114154951 | A * | 3/2022 | G06Q 10/20 |
| CN | 116450644 | B * | 12/2025 | G06Q 50/40 |
| KR | 20120126375 | A * | 11/2012 | B61L 27/00 |

* cited by examiner

*Primary Examiner* — Jason C Smith
(74) *Attorney, Agent, or Firm* — Justin Lampel

(57) ABSTRACT

The present invention relates to a subway vehicle electronic record system based on blockchain technology, which mainly includes business view module, record information maintenance module, statistical analysis module, record information management module, system management module, and blockchain foundation platform. The invention comprehensively makes use of blockchain, database and other technologies to normalize heterogeneous data of subway vehicle record.

6 Claims, 8 Drawing Sheets

SUBWAY VEHICLE ELECTRONIC RECORD SYSTEM BASED ON BLOCKCHAIN TECHNOLOGY

FIELD OF THE INVENTION

The present invention relates to the management of urban rail transportation information, and more particularly to a subway vehicle electronic resume system based on blockchain technology.

BACKGROUND OF THE INVENTION

Because the subway vehicle record information system data information has a wide sources, is applied by multiple departments, involving operation units, management units, vehicle manufacture units, parts manufacture units, etc., the transfer and application of different data could be completed by Internet technologies. With the development of Internet technologies, network security has drawn more and more attention. A large number of sites in China still face with large security risks, during which the domain hijacking, server intrusion, and content tampering are relatively serious. Therefore, the security shall be taken into consideration at the early stage for the establishment of the subway vehicle record information system.

Blockchain is a decentralized, trustless, tamper-proof distributed ledger technology, which comprehensively utilizes a variety of computer technologies such as cryptography, probability theory, consensus mechanism and distributed network, and is a great innovation in made by the Internet. The decentralized, trustless, tamper-proof information stored on the blockchain are very suitable for the protection of electronic files. Despite the blockchain technology has lots of advantages, it still has problems such as low access efficiency and high economic costs. Blockchain shall be used as a supplementary technical means in combination with other technologies rather than replacing the existing database technologies.

In summary, the current electronic record management of subway vehicles have the problems such as poor system security, easy tampering and destruction.

SUMMARY OF INVENTION

In order to solve the above technical barriers, the present invention comprehensively utilizes a variety of technologies such as blockchain, database, digital archive construction, etc., researches and designs and develops a subway vehicle electronic record system based on blockchain technology, and normalizes heterogeneous data of subway vehicle record, realize the authenticity and security protection of subway vehicle record and the traceability and recovery of archival history information, realize the informationization and paperless of subway vehicle and main parts record, to save manpower and material resources, improve work efficiency, as well as provides rich and accurate information resources for the manufacture, operation, maintenance, performance improvement, quality promotion, fault prediction, guarantee of traffic safety and improvement of economic efficiency of subway vehicles. The invention specifically utilizes the following technical proposal:

A subway vehicle electronic record system based on blockchain technology is characterized in that the system includes:

A business view module which allows the users with different functions to access record information view with different dimension;

A record information maintenance module, which is used to add, modify and search data information about subway vehicle records according to different stages and different functions as well as allow the personnel of the responsible departments to access the maintenance function for the vehicle record information, for which purpose the "stages" refers to procurement, operation, renewal and reconstruction, and the "functions" refers to maintenance, repair and assets;

A statistical analysis module, in which the vehicle information could be searched, sorted out and analyzed from different management dimensions, for data statistical analysis related to vehicle, which could displayed in table, charts and other ways Record information management module, which is for the management and maintenance of subway vehicle basic information, parts, data collection, suppliers and data security; for this purpose, the "subway vehicle basic information" includes subway vehicle models, subway vehicle configuration, subway vehicle grouping, etc.;

A system management module, which is for the management of organizational system, personnel, system roles, authority and log monitoring;

A blockchain foundation platform, which is for the visual deployment, upgrading, and updating of smart contracts, as well as the uploading the record data to blockchain and storage and verification of record data.

Preferentially, the record information view includes a configuration view, a status view, an operation view, and an asset view The said configuration view, which adopts the vehicle management manner of the host enterprise to uniformly standardize the names of vehicle components of different host enterprises, determine a series of unified subway company's "label" for the vehicle component names, establish an arbitrary level of product decomposition structure to realize the refined and complete management view of the composition of the subway vehicle, as well as the substitution and alteration of the key components of the vehicle information;

The said status view, which could view the technical documents, maintenance/conservation specifications, spare parts/parts, and current status of the operating vehicles and major components, based on the functional structure of the daily maintenance of the operating company and available authority of the corresponding subway vehicles and vehicle components data granted by different operating companies;

The said operation view, which is used to warn, monitor in real time and search the history data based on the overhaul operation data, fault information data and operation information data of subway vehicle and major components published by different operating companies from the management perspective of operating companies;

The said asset view, which realizes the whole process of closed-loop management for the vehicle assets from the company's subway vehicle procurement, operation, renewal and transformation, vehicle parts and components of the spare parts/pieces of the procurement, warehousing, collocation, change, maintenance, transfer to the renewal and transformation of the disposal dimension to show of spare parts/pieces of vehicle parts and components from the perspective of assets management department of subject company.

Preferentially, the said record information includes vehicle record information, components and parts information, operation data information, and maintenance/repair information;

The said vehicle record information, which realizes the record information maintenance and management of structured and non-structured data such as basic data, state information, repair and maintenance information, spare parts and components, and other structured and unstructured data of the subway vehicle by providing the vehicle record information query and maintenance function for the operating company, according to the norms and requirements of the configuration management of the subway vehicle, and realizes the change of the subway vehicle, the key components and the historical information traceability through the record version control; comprehensively displaying data information such as basic information, fault information, overhaul information, status information, transformation information, key parts information, equipment data, etc. of subway vehicles;

The said parts information, which realizes the query and maintenance of the inventory, storage unit, quantity and other information of the spare parts and components, and replacement parts of the vehicle parts, effectively utilizing the life of the parts and reducing the inventory level, and at the same time realize the full life cycle management of the key parts, as well as realizes the reverse tracing of the information in the stages of overhauling, operation, production and design by serial number in case of a problem;

The said operation data information, which realizes the reporting and query function of the operation status log information of the subway vehicle and key components, control system and train-to-ground communication system and other information;

The said maintenance/repair information, which realizes the reporting and query of operation data of subway vehicles and key components.

Preferentially, the data queried and analyzed by the said statistical analysis module include an asset ledger, a vehicle ledger, a parts ledger, and a statistical statement.

Preferentially, the said record information management module is used for model management, configuration management, vehicle management, grouping management, parts management, supplier management, data collection management, and information setting;

The said model management, which covers all models of train information, including train models, names and other key information, and realizes functions such as creation, updating and deletion of models;

The said configuration management, which realizes the configuration directory template creation, node creation, label definition, node information project configuration and other management and maintenance functions of subway vehicle, provides the basic directory framework for the information maintenance of the vehicle configuration in the later stage, as well as establishes metadata, data definitions, constrains, data relations for vehicle and provide management function for data, according to the subway vehicle configuration management specification;

The said vehicle management, which establishes management configuration and functional configuration for the newly purchased subway vehicles and existing subway vehicles, and defines the vehicle configuration hierarchy, attributable range of hierarchical parts and other functions, according to the subway vehicle configuration management specification;

The said grouping management, realizes the detailed information related to all line assignments of the company, which can be associated with multiple conditions such as line assignment, operating company, model, group number, telegraph number, assignment type, assignment date, etc., and displays the maintenance and management functions of line assignments, the current state of the vehicle group, the form of the grouping, and the information of the manufacturing plant;

The said parts management, which is used for the construction of parts of the location, type, function and other multi-dimensional management model, and the attributes information in the defining part provides a visual display of the full life cycle of a single piece of maintenance template for the query and maintenance of vehicle record information;

The said supplier management, which is for management and maintenance of subway vehicle host manufacturers, parts suppliers and operation and maintenance manufacturers information;

The said data collection management, which is for the collection, cleaning, arrangement, management and maintenance of data related to subway vehicle;

The said information setting, which is for the management of vehicle maintenance/repair, routing inspection, testing and other types of code table information, as well as maintenance of subway vehicle fault type and fault code relationship.

Preferentially, the data uploading to the blockchain covers the full life cycle of the subway vehicle project establishment, design liaison, supervision and manufacture, check and acceptance, operation, and scrapping, and according to the type of data uploaded to the blockchain, includes the basic vehicle configuration data, vehicle state information, operation and maintenance data, and relevant documents;

On-chain contracts include basic function contracts and business contracts, in which the basic function contracts aim to manage and control the permission scheme on each node in the blockchain, user login and other basic functions; the business contracts involve data that need to be uploaded to the blockchain in different business phases, including the contract for registration of project establishment, contract for uploading of project documents, contract for analysis of vehicle configuration, contract for updating of design liaison data, contract for updating supervision on manufacture data, contract for uploading supervision on manufacture documents, and contract for registering leave-factory check and acceptance.

The said data uploaded to blockchain is optimized by the blockchain structure to realize flexible uploading, and whether or not to upload the data is selected at different business stages according to user requirements.

Preferentially, based on the files in forms of excel, word, and pdf collected by the users, with the information technology, full-text search technology, and structural analysis technology, the functions of target data identification, serialization processing, association with unstructured data, storage, and construction of query indexes, etc. are realized, and upon satisfying the user's basic query and statistical analysis functions, the knowledge base is gradually formed, and provides users with maintenance guidance and repair program and system support for users in the form of correlation knowledge.

The present invention has the following beneficial effects:

(1) Normalization of heterogeneous information about subway vehicle record. The invention integrates and normalizes the data distributed in different data sources, data of different types and formats into the accurate, complete and non-ambiguous data so as to provide accurate and effective data sources for research and analysis related to subway vehicle operation and maintenance.

(2) Retention of subway vehicle information. The invention electronizes the paper vehicle records, which solved a series of problems such as the difficulty of preserving paper vehicle history, complicated and overloaded updating, inconvenient access, and at the same time, the electronic vehicle record could be accessed at any terminal equipment, saving lots of subway vehicle data, accelerating the data transfer and improving the utilization rate of the data.

(3) Simplify the maintenance of the subway vehicle maintenance. The subway vehicle electronic record system could provide a larger, more convenient platform for storing the information and data about subway vehicles which simplify the maintenance of the subway vehicle record while retaining the important information of the vehicle, but also facilitate the overhaul of the subway vehicle, improving the efficiency of the overhaul of vehicles.

(4) Assist in maintenance decision. It could assist other professional systems to conduct data analysis and modeling calculations and intelligent judgment decision-making on subway vehicles based on the subway vehicle electronic record information, realizing the subway vehicle dynamic data perception, fault identification and prediction, maintenance assistance decision-making, etc.

(5) Enhancement of internal and external credibility of data. Due to the technical features of blockchain "decentralization, anti-tampering, traceability, and credible transmission", it could solve the systematic data transmission loss, realize the credible sharing of internal and external data, and improve the supervision on the internal data integrity, enhance the credibility of the data, add the value of the data, and empower the data.

DETAILED DESCRIPTION OF THE PREFERRED EMBODIMENTS

Figure 1:
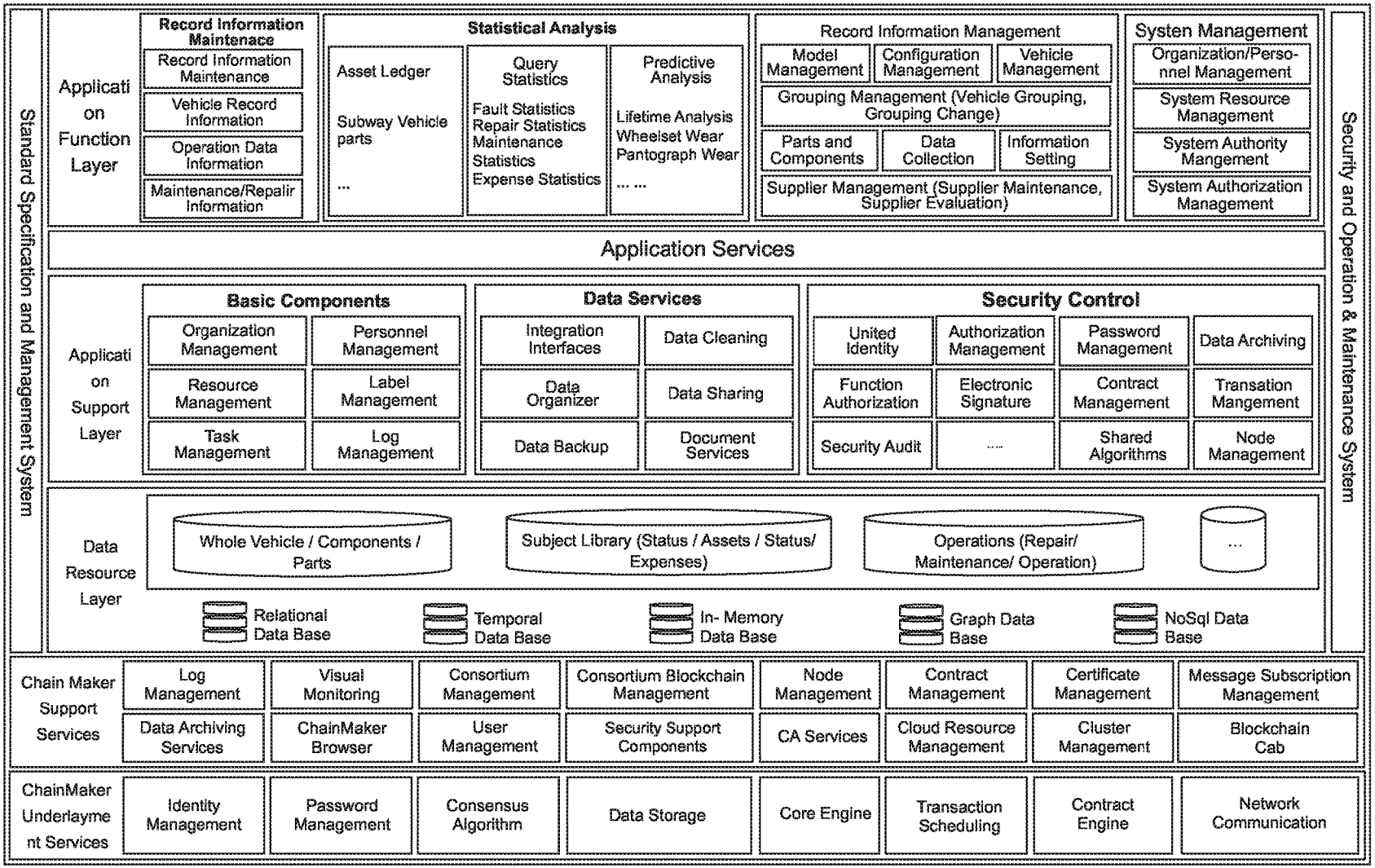
FIG. 1 is a diagram of the general architecture of the system of the present invention.

The subway vehicle electronic record system based on blockchain technology follows the standards and meet the requirements of informationization construction, have the features of scientization and humanization, and at the same time takes the standard as the premise, data as the core, security and operation and maintenance as the guarantee, and application as the purpose. Based on the construction objectives and content requirements, it not only considers the daily storage, query, use and other functions of subway vehicle record management, but also the data fusion among different lines and trains, in order to eliminate the problems of information isolated island and data isomerism, realize the integrated management of record information of various lines as well as lay a solid foundation for the maintenance, operation management and technical analysis of subway vehicles. It conducts system design and construction. The overall architecture of the system shall include data resources, application support, application services and so on. The overall architecture of the system of the present invention is shown in FIG. 1.

The subway vehicle electronic record system based on blockchain technology adopts B/S architecture and J2EE technology route, and integrates technologies and products such as relational database, middleware, business flow, form and Internet, so as to provide users with a unified and friendly interface and powerful data processing capability, and leave sufficient room for future upgrade of the system, so as to make the system set of advancement, ease of operation, scalability, and security. The technical realization architecture of the system is shown in FIG. 2.

Figure 2:
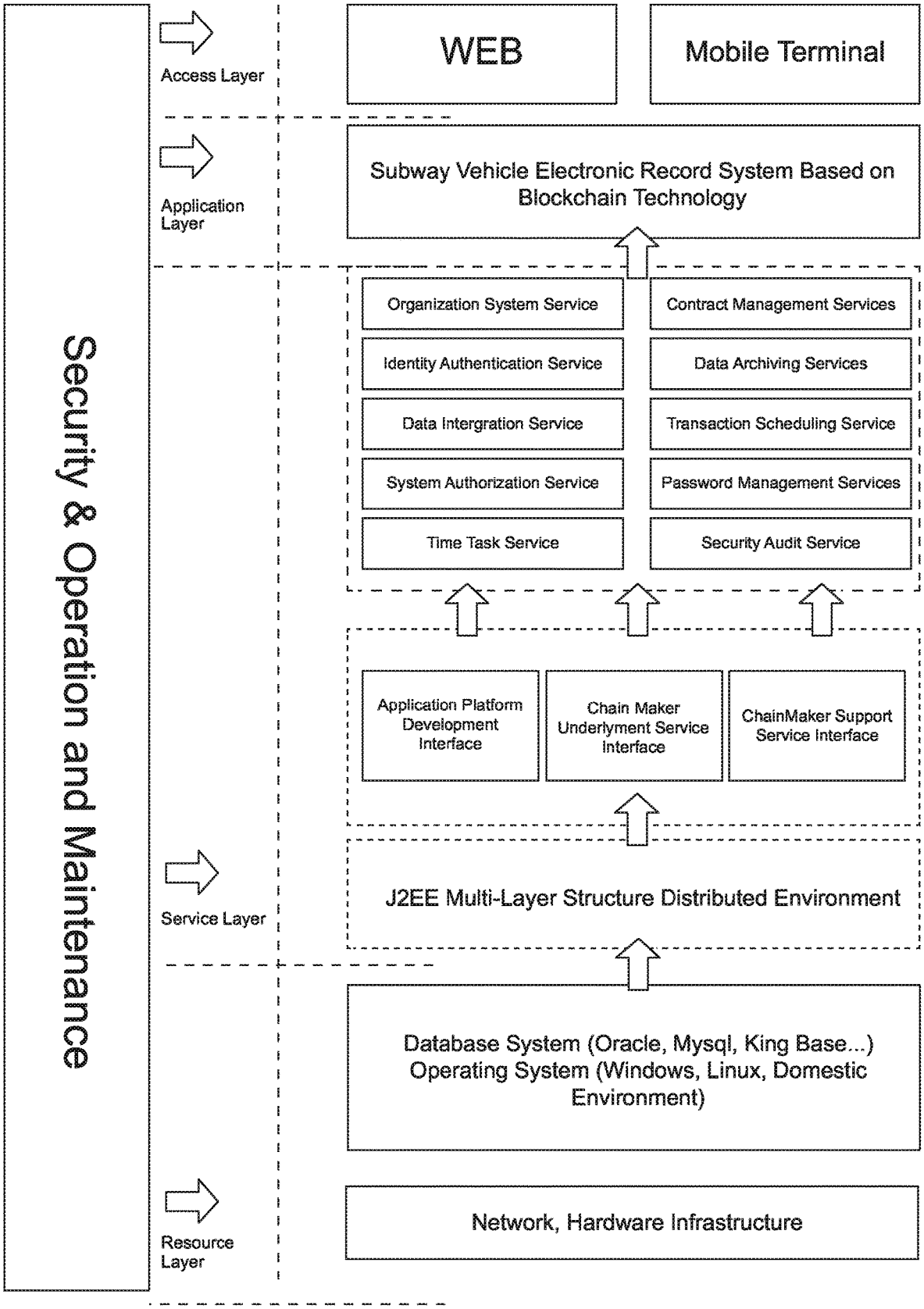
FIG. 2 is a diagram of the technical architecture of the present invention.

According to FIG. 2, the technical realization framework consists of access layer, application layer, service layer and resource layer from top to bottom. In the construction of the system, it is necessary to build an application support platform based on J2EE, and on this platform, realize the functional requirements of the subway vehicle electronic record system based on blockchain technology after configuration, development, and integration.

The system is mainly composed of a platform for application development and expansion support as well as a series of mature application software frameworks. The application support platform shall have good cross-platform capability which can be applied on the middleware of various mainstream and operating systems without modification. Moreover, the system provides mature database access adapters, which enable the system to adapt to the database management systems such as Oracle, MS SQL Server, DB2, MySQL, Dameng, and King Base. Therefore, the system based on the application support platform can be fully meet the users' requirements and satisfy various network environments, host environments, and underlying software operation environments. The system provides a variety of authentication methods for user authentication, so as to ensure system security.

Figure 3:
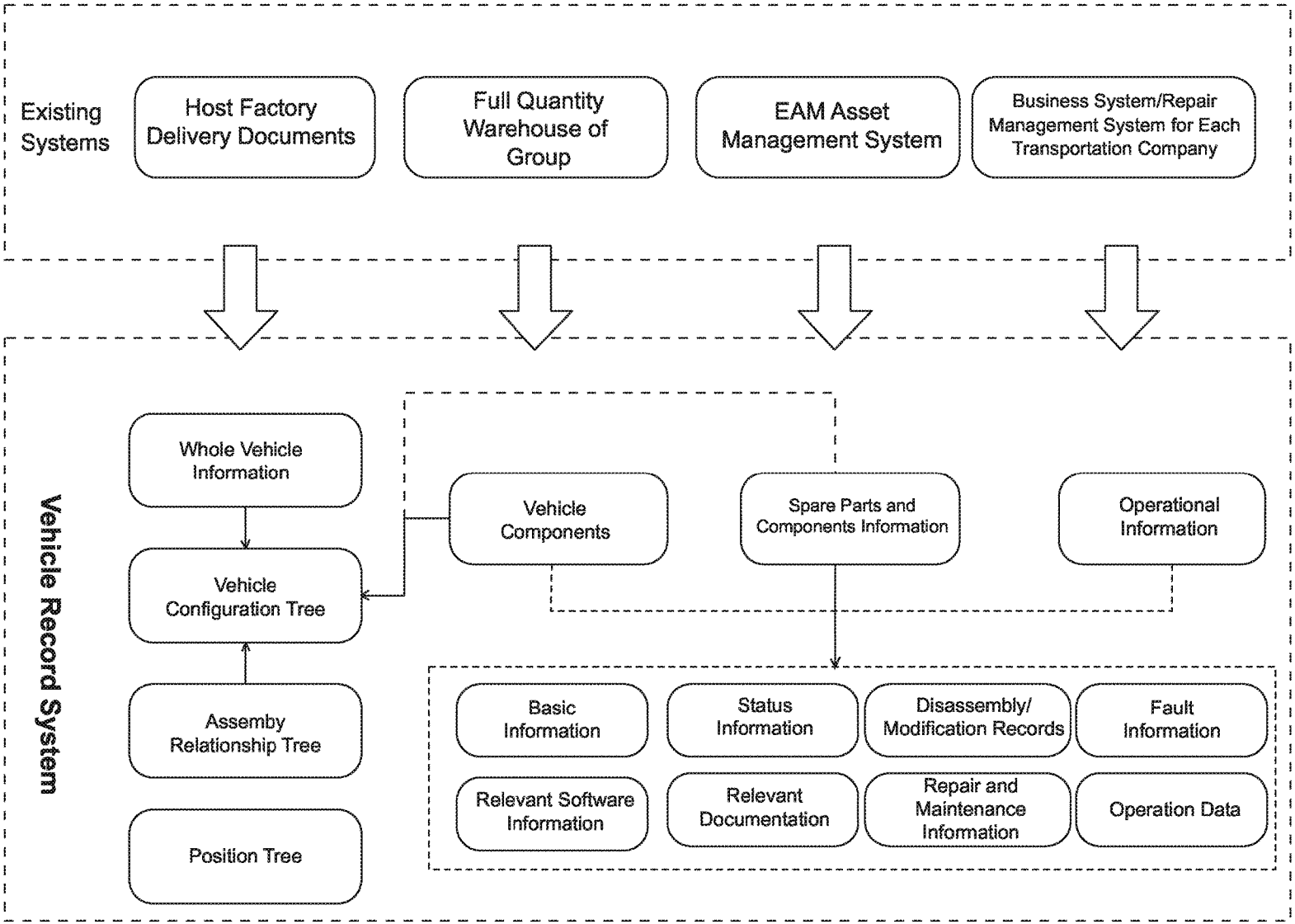
FIG. 3 is a data integration relationship diagram.

The present invention subway vehicle record management system construction is mainly realized by the data integration of the host factory, full quantity warehouse of group, EAM asset management system and each transport branch of the business management system or maintenance management system. The data integration relationship of the present invention is shown in FIG. 3.

1 System Functional Design 1.1 Electronic Record Application System

Figure 4:
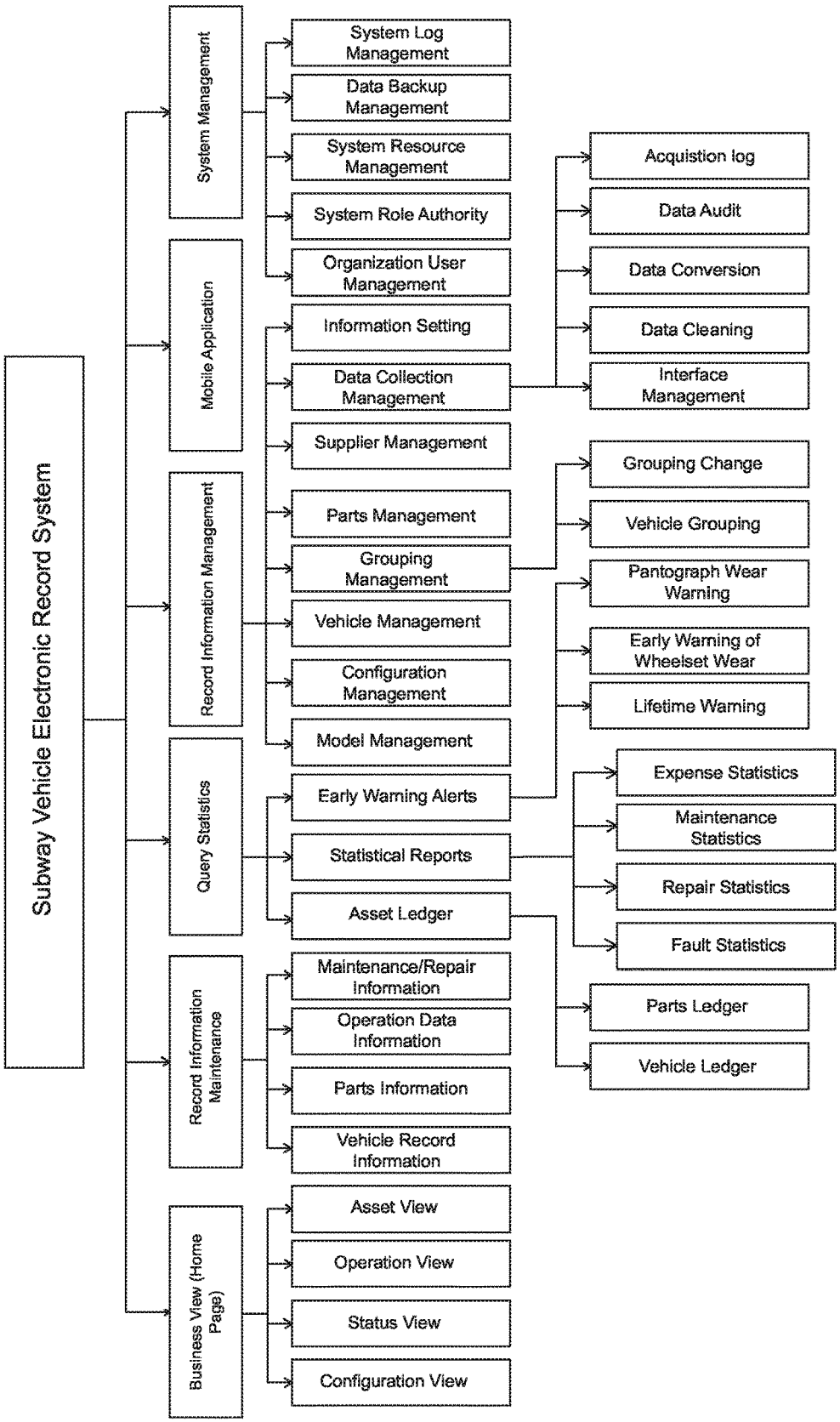
FIG. 4 is a schematic diagram of the system function modules of the present invention.

Based on the requirements of electronic record management of subway vehicles, according to the collection and analysis of the needs of subway business departments, the "Subway Vehicle Electronic Record System Based on Blockchain Technology" mainly includes "Record Information View-Business View", "Record Information Maintenance", "Statistical Analysis", "Record Information Management", "System Management", and several modules of the blockchain foundation platform. The schematic diagram of the system function modules of the present invention is shown in FIG. 4.

1.1.1 Business View

Open up the record information view under different maintenance for users based on different functions.

1.1.1.1 Configuration View

Adopts the vehicle management manner of the host enterprise to uniformly standardize the names of vehicle components of different host enterprises, determine a series of unified subway company's "label" for the vehicle component names, establish an arbitrary level of product decomposition structure to realize the refined and complete management view of the composition of the subway vehicle, as well as the substitution and alteration of the key components of the vehicle information 1.1.1.2 Status View View the technical documents, maintenance/conservation specifications, spare parts/parts, and current status of the operating vehicles and major components, based on the functional structure of the daily maintenance of the operating company and available authority of the corresponding subway vehicles and vehicle components data granted by different operating companies.

1.1.1.3 Operation View

Warn, monitor in real time and search the history data based on the overhaul operation data, fault information data and operation information data of subway vehicle and major components published by different operating companies from the management perspective of operating companies 1.1.1.4 Asset View Realize the whole process of closed-loop management for the vehicle assets from the company's subway vehicle procurement, operation, renewal and transformation, vehicle parts and components of the spare parts/pieces of the procurement, warehousing, collocation, change, maintenance, transfer to the renewal and transformation of the disposal dimension to show of spare parts/pieces of vehicle parts and components from the perspective of assets management department of subject company.

1.1.2 Record Information Maintenance

In order to ensure the completeness, timeliness and availability of information related to vehicle record, it provides manual maintenance functions on the basis of automatic data collection. It provides the maintenance function of vehicle record information for the personnel of the responsible departments, realizing the addition, modification and query of data and information of subway vehicle record according to different stages (procurement, operation, renewal and reconstruction) and different functions (repair/maintenance, assets, etc.).

1.1.2.1 Vehicle Record Information

Realize the record information maintenance and management of structured and non-structured data such as basic data, state information, repair and maintenance information, spare parts and components, and other structured and unstructured data of the subway vehicle by providing the vehicle record information query and maintenance function for the operating company, according to the norms and requirements of the configuration management of the subway vehicle, and realizes the change of the subway vehicle, the key components and the historical information traceability through the record version control.

Comprehensively display data information such as basic information, fault information, overhaul information, status information, transformation information, key parts information, equipment data, etc. of subway vehicles.

1.1.2.2 Parts Information

Realize the query and maintenance of the inventory, storage unit, quantity and other information of the spare parts and components, and replacement parts of the vehicle parts, effectively utilizing the life of the parts and reducing the inventory level, and at the same time realize the full life cycle management of the key parts, as well as realizes the reverse tracing of the information in the stages of overhauling, operation, production and design by serial number in case of a problem.

1.1.2.3 Operation Data Information

Realize the reporting and query function of the operation status log information of the subway vehicle and key components, control system and train-to-ground communication system and other information.

1.1.2.4 Maintenance/Repair Information

Realize the reporting and query of operation data of subway vehicles and key components. If the advanced repair regulations and the use of maintenance cards can be compared horizontally, the respective technical information organization structure could be divided uniformly cut in such a manner.

1.1.3 Query Statistical Analysis

The vehicle information could be searched, sorted out and analyzed from different management dimensions, for data statistical analysis related to vehicle, which could displayed in table, charts and other ways.

1.1.3.1 Asset Ledger

Realize the electronic and standardized preservation of all subway vehicle ledgers, in which case the historical data and present asset of the subway vehicle and parts could be counted and sorted out in a quick and accurate manner, the equipment log of full life cycle records all the changes in the equipment so the it is easy to be traced and analyzed.

1.1.3.2 Vehicle Ledger

Statements of operating company, status (operation, maintenance, renewal and reconstruction), date, line and other types of dimensions in which case it could meet the demands of subway vehicle asset data analysis, so that equipment management could be clear and transparent.

1.1.3.3 Parts Ledger

Statements of operating company, inventory, part, storage location, status, date and other types of dimensions, which could provide timely and accurate inventory warning, and rationally schedule the inventory.

1.1.3.4 Statistical Statement

1. Failure statistics. Provide multi-dimensional vehicle failure statistics of components, vehicles, systems, etc. for each operating companies which could be displayed in forms of tables, charts and other methods, providing support for monthly, annual reports and vehicle failure analysis.

2. Maintenance statistics. Through the query statistics, query the data related to the corresponding vehicle record and conduct statistical analysis according to different attributes of query conditions, and upon the comparison, find out the proportion of failure types, high failure types, high wear parts and components types, etc., providing data support for the subway vehicle maintenance, operation management. The most cost-effective suppliers of parts and components could be selected based on the cost information so as to reduce the costs of the operation and maintenance of the subway.

3. Maintenance statistics and cost statistics. Provide the information of the expenses related to the maintenance and repaid of the vehicle which could be displayed in the forms of tables, charts and other methods.

1.1.3.5 Warning Alert

1. Life warning: Different parts are set the expected service life which can be updated when conducting the maintenance and repair. The life loss would be automatically recorded as from leaving the factory or replacing the parts. When the expected service life of the parts expires (or close to the manufacturer's warranty period), a notice message will be sent;

2. Wear parts warning: similar to the description of the "Life Warning";

1.1.4 Record Information Management

Realize the management and maintenance functions of the basic information of subway vehicles (subway vehicle models, subway vehicle configurations, subway vehicle groupings, etc.), parts, data collection, suppliers and data security.

1.1.4.1 Model Management

The said model management covers all models of train information, including train models, names and other key information, and realizes functions such as creation, updating and deletion of models 1.1.4.2 Configuration Management Realize the configuration directory template creation, node creation, label definition, node information project configuration and other management and maintenance functions of subway vehicle, provides the basic directory framework for the information maintenance of the vehicle configuration in the later stage, as well as establishes metadata, data definitions, constrains, data relations for vehicle and provide management function for data, according to the subway vehicle configuration management specification 1.1.4.3 Vehicle Management Establish management configuration and functional configuration for the newly purchased subway vehicles and existing subway vehicles, and defines the vehicle configuration hierarchy, attributable range of hierarchical parts and other functions, according to the subway vehicle configuration management specification 1.1.4.4 Grouping Management Realize the detailed information related to all line assignments of the company, which can be associated with multiple conditions such as line assignment, operating company, model, group number, telegraph number, assignment type, assignment date, etc., and displays the maintenance and management functions of line assignments, the current state of the vehicle group, the form of the grouping, and the information of the manufacturing plant 1.1.4.4.1 Vehicle Grouping Manage and maintain the grouping of all route vehicles.

1.1.4.4.2 Change in Grouping

Realize the history of transferring and assigning between vehicle lines and groupings. Support the query and maintenance of the time of assignment, model, group number and other perspectives.

1.1.4.5 Parts Management

Construct parts of the location, type, function and other multi-dimensional management model, and the attributes information in the defining part provides a visual display of the full life cycle of a single piece of maintenance template for the query and maintenance of vehicle record information 1.1.4.6 Supplier Management Conduct the management and maintenance of subway vehicle host manufacturers, parts suppliers and operation and maintenance manufacturers information 1.1.4.6.1 Supplier Maintenance Realize the classification of suppliers, and the creation, modification, query, statistics and other functions of supplier information.

1.1.4.6.2 Supplier Evaluation

According to the company's supplier evaluation system, it evaluates the supplier's products quality and service level, price, punctuality, creditworthiness, etc., so as to lay the foundation for the selection of suppliers.

1.1.4.7 Data Collection Management

Manage and maintain the collection, cleaning, arrangement, management and maintenance of data related to subway vehicle 1.1.4.7.1 Interface Management Manage and maintain interfaces with multi-source heterogeneous vehicle record information resources such as the unified identity system of the group company and transportation branch, intelligent overhaul, and production system of the transportation branch.

1.1.4.7.2 Data Cleaning

Review the integration interface data for each heterogeneous system, as well as define and maintain validation rules.

1.1.4.7.3 Data Conversion

Data cleansing/conversion management for different data of each heterogeneous system, such as value mapping, column and row split, column to row, row to column, string clipping, de-duplication, filtering, string replacement, field splitting, etc.

1.1.4.7.4 Data Audit

Review and browse the structured data and unstructured files collected by the integration, data review and other functions.

1.1.4.7.5 Collection Log

Log query for the collection tasks of data collection interface, and restart the function in case of a failure. Record the collection interface tasks through the collection log function, system administrator review and query the log, restart in case of a failure, while providing a variety of ways to query the statistical functions.

1.1.4.8 Information Setting 1.1.4.8.1 Overhaul Type

Manage the information of vehicle repair/maintenance, inspection, testing and other types of code lists, such as whole-train inspection\monthly inspection\scheduled repair\frame repair\factory repair.

1.1.4.8.2 Fault Type

Manage the maintenance of subway vehicle fault types and fault coding relationships, etc.

1.1.5 System Management

Implement system management functions such as organization system, personnel, system roles, permissions and log monitoring.

1.1.5.1 Organization System Management

Manage and maintain the import of organizational information of the group and subsidiaries and the management of information in this system, mainly providing functions of adding, modifying (adjusting), deleting and inquiring information.

1.1.5.2 Personnel & User Management

The user system is established according to the establishment of the organization. User information includes basic information, business role information (job maintenance), and other functions.

1.1.5.3 System Resource Management

Realize the management and maintenance of modules, resources, system roles, system role authorities, and tabs throughout the system, defines all modules, resources, system roles, system permissions, and tabs within the system, and determines the operational authority each role in the system.

1.1.5.4 System Authority Management

Define virtual roles to facilitate the management of authorization and authority control of the platform. Realize the system roles defined in the resource configuration to be assigned to specific personnel in the system, control system module access and operation authority, data access and operation rights control.

1.1.5.5 System Authorization Manage

Realize administrator authorization, menu authorization, role authorization, so that the system administrators can carry out the process and form authorization to the system user, which can be sub-authorized down to the next level 1.1.5.6 Data Backup Realize the functions of system data backup, restore and import/export data, record the information of each operation such as reading/writing and deleting, and be the last ditch for system security.

1.1.5.7 Operational Log Management

Realize the record of system user login, users' access operation log, system exception and other logs, including log query, log backup, log export and other functions.

1.2 Blockchain Basic Platform

The present invention constructs a vehicle history integrity data model for subway vehicle information resource data, covering the full life cycle and detailed to the smallest maintenance unit, while improving the application value of the vehicle record data based on the blockchain to guarantee the security, mutual trust, mutual recognition and sharing of the data, so as to provide technical support for realizing the automated management of the company's equipment operation and improving the level of operation and production.

The data uploading to the blockchain covers the full life cycle of the subway vehicle project establishment, design liaison, supervision and manufacture, check and acceptance, operation, and scrapping, and according to the type of data uploaded to the blockchain, includes the basic vehicle configuration data, vehicle state information, operation and maintenance data, and relevant documents.

The on-chain contracts of the present invention is designed based on the business demands of the various business stages of the vehicle electronic record system among which the basic function contracts aim to manage and control the permission scheme on each node in the blockchain, user login and other basic functions, including the blockchain access control contract, the digital identity management contract, and the data privacy protection contract. The business contracts correspond to the six business phases of the record system, such as project establishment, design liaison, and supervision and construction, and are designed for the data that need to be uploaded to the blockchain in different business phases, including the contract for registration of project establishment, contract for uploading of project documents, contract for analysis of vehicle configuration, contract for updating of design liaison data, contract for updating supervision on manufacture data, contract for uploading supervision on manufacture documents, and contract for registering leave-factory check and acceptance.

The uploaded to blockchain is optimized by the blockchain structure to realize flexible uploading, and whether or not to upload the data is selected at different business stages according to user requirements.

The prevention invention adopts the private chain with three levels of equal protection to guarantee the security of the company's operation data. Based on the files in forms of excel, word, and pdf collected by the users, with the information technology, full-text search technology, and structural analysis technology, the functions of target data identification, serialization processing, association with unstructured data, storage, and construction of query indexes, etc. are realized, and upon satisfying the user's basic query and statistical analysis functions, the knowledge base is gradually formed, and provides users with maintenance guidance and repair program and system support for users in the form of correlation knowledge.

1.2.1 Blockchain Bottom Chain

The underlying technology platform based on ChainMaker mainly covers the following functional modules:

1) Core Engine: the main program of the underlying technology platform calls other modules based on the dependency relationship between modules and configuration parameters to complete the overall functions of the ChainMaker system. The components of contracts, transaction scheduling, consensus, storage and other modules of the ChainMaker system are directly controlled by the core engine, which can command all the elements to operate in parallel and in an orderly manner in the backstage.
2) Network Communication Module: Realize the interface for sending transactions between nodes, including peer-to-peer sending and broadcasting. Support various types of nodes such as consensus nodes (participation consensus, candidate nodes), synchronous nodes, spv nodes, and at the same time, realize the dynamic addition and deletion of participants (or organizations) and nodes. The node requirements can be flow-limited. Support network blacklist, whitelist and other security management systems.
3) Identity Management Module: Provide authority configuration and permission authority interfaces to control the access of members, smart contract calling and other operation authority. In the Consortium Blockchain, the deployment of smart contracts, participation in consensus and other operations on the chain shall be set with certain authority control policies to manage the identity of the participants on the chain.
4) Consensus Algorithm Module: it aims to ensure that the data of all participants of the blockchain are strictly consistents.
5) Smart Contracts: It aims to realize the users' specific business logic, accept the call proposed by the users, and generate a collection of update operations on the data uploaded to the chain after a series of operations with the combination of the users' input and the current state of the chain.
6) Transaction Scheduling Module: Packages and sorts a batch of transactions and them submits them to the consensus module, in which case other nodes can process them in parallel as much as possible when conducting block validation in order to reduce the block validation period
7) Cryptographic Service Module: Supports encapsulation and realization of cryptographic algorithms, and carries out full-link security protection by adopting cryptographic methods such as hashing algorithm, symmetric encryption algorithm, asymmetric algorithm, transport layer security mechanism, key management mechanism and other cryptographic methods.
8) Data Storage Module: Provides a unified data model and defines a unified data access interface to support a variety of data storage components.

1.2.2 Logical Structure

Figure 6:
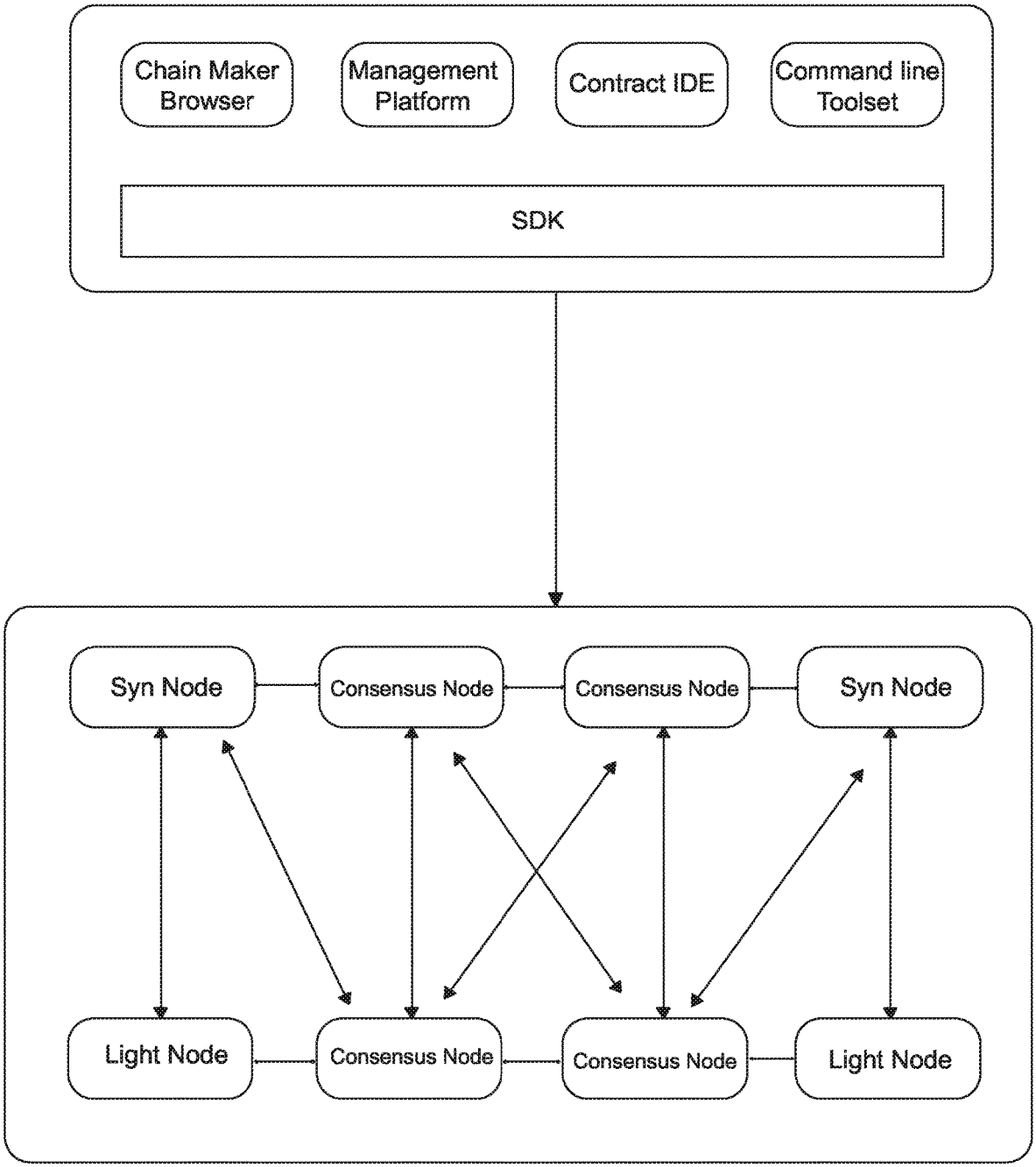
FIG. 6 is a diagram of the logical architecture of the blockchain bottom chain.

The logical architecture of ChainMaker is shown in FIG. 6. It mainly contains the following elements:

Consensus node: a node that participates in consensus voting, transaction execution, block verification, and bookkeeping in the blockchain network.

Sync node: also known as witness node, participates in block and transaction synchronization, block validation, transaction execution, and records the complete ledger data, but does not participate in consensus voting.

Light node: a node that participates in synchronizing and verifying block header information and verifying the existence of transactions.

SDK: helps users to connect to the blockchain network through RPC, and complete the functions of contract creation, invocation, and chain management.

ChainMaker browser: display block information, transaction information, node information and other blockchain information for users through a visualized interface.

Management platform: facilitates users' chain management, information browsing and resource monitoring through a visualized interface.

Contract IDE: an online development environment for smart contracts, all contract support languages of ChainMaker can be developed and compiled on this IDE.

ChainMaker CLI, cmc: enable users to deploy and manage the chain, such as certificate generation, chain configuration, transaction sending, etc. in a command line manner.

1.2.3 Hierarchical Architecture

Figure 7:
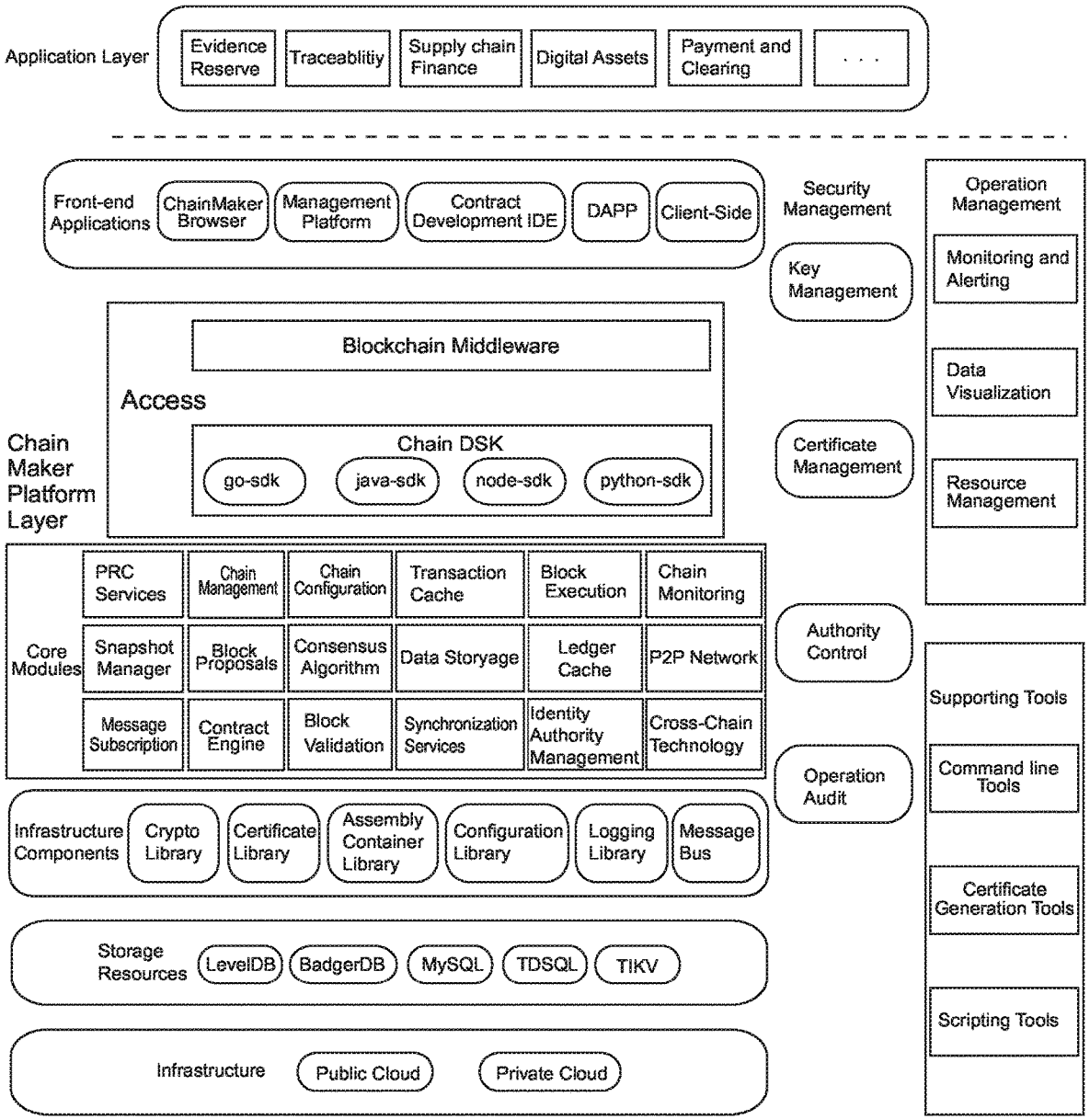
FIG. 7 is a diagram of the blockchain bottom chain hierarchical architecture.

The ChainMaker hierarchical architecture from bottom to top is shown in FIG. 7, which is composed of the following layers:

Infrastructure Layer: Public and private clouds, including virtual machines and physical machines, provide the basic operating environment for ChainMaker.

Storage Resource Layer: Provide data storage services for ChainMaker nodes, and details can be found in the Data Storage chapter.

Basic Component Layer: Provide ChainMaker nodes with common technical components such as cryptography, configuration, logs, common data structures, etc. For details, please refer to the chainmaker-common project.

Core Module Layer: ChainMaker consensus algorithm, core engine, virtual machine and other core modules which adopt pluggable design, laying the foundation for assembly blockchain.

Access Layer: Multi-language chain SDK, facilitate the interaction between application developers and the chain.

Front-End Application Layer: including blockchain management platform, ChainMaker browser, contract development IDE, etc., which facilitates users to directly access the underlying blockchain platform.

1.2.4 Core Process

Figure 8:
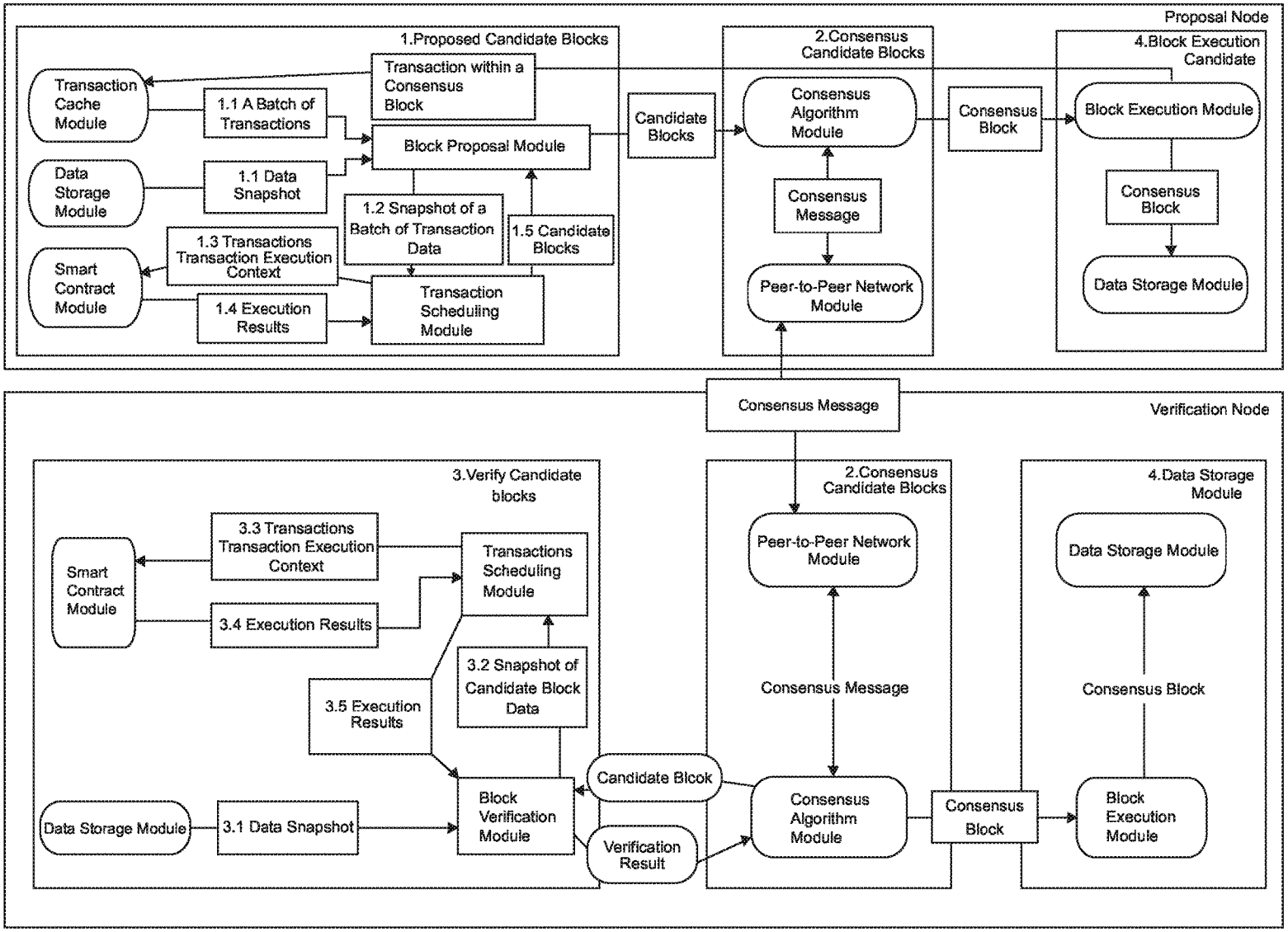
FIG. 8 is a core flow chart of block generation.

The core process generated by the ChainMaker is shown in FIG. 8, which mainly includes:

Propose candidate blocks. The block proposing node selects a batch of transactions from the trading pool, schedules the execution in parallel to generate the DAG, and broadcasts the block and the DAG.

Consensus candidate block. Based on the on-chain consensus mechanism, consensus voting is performed on the candidate block.

Verification of candidate blocks. During the consensus process, other nodes in the network verify the correctness against the proposed candidate block.

Execution of candidate block. The blocks of which consensus voting have been completed are submitted for recording to the ledger and the corresponding transaction cache will be deleted.

1.2.5 Platform BaaS Supported by Blockchain

ChainMaker Support Service Platform is a visual management platform based on blockchain bottom chain, which functions are featured by visualization, ease of use, customizability, etc., providing general important function modules for the management of ChainMaker, mainly including:

1) Organization Management Center: account management, consortium management, business chain management, strategy management, node management, smart contract management, blockchain browser, certificate management, operation and maintenance work order, log management, work order management, and message management.

2) Platform Management Center: organization management, and business chain management.

3) Operation and Maintenance Management Center: monitoring service, alarm service, management of log operation and maintenance.

1.2.6 Blockchain Application Design

Figure 5:
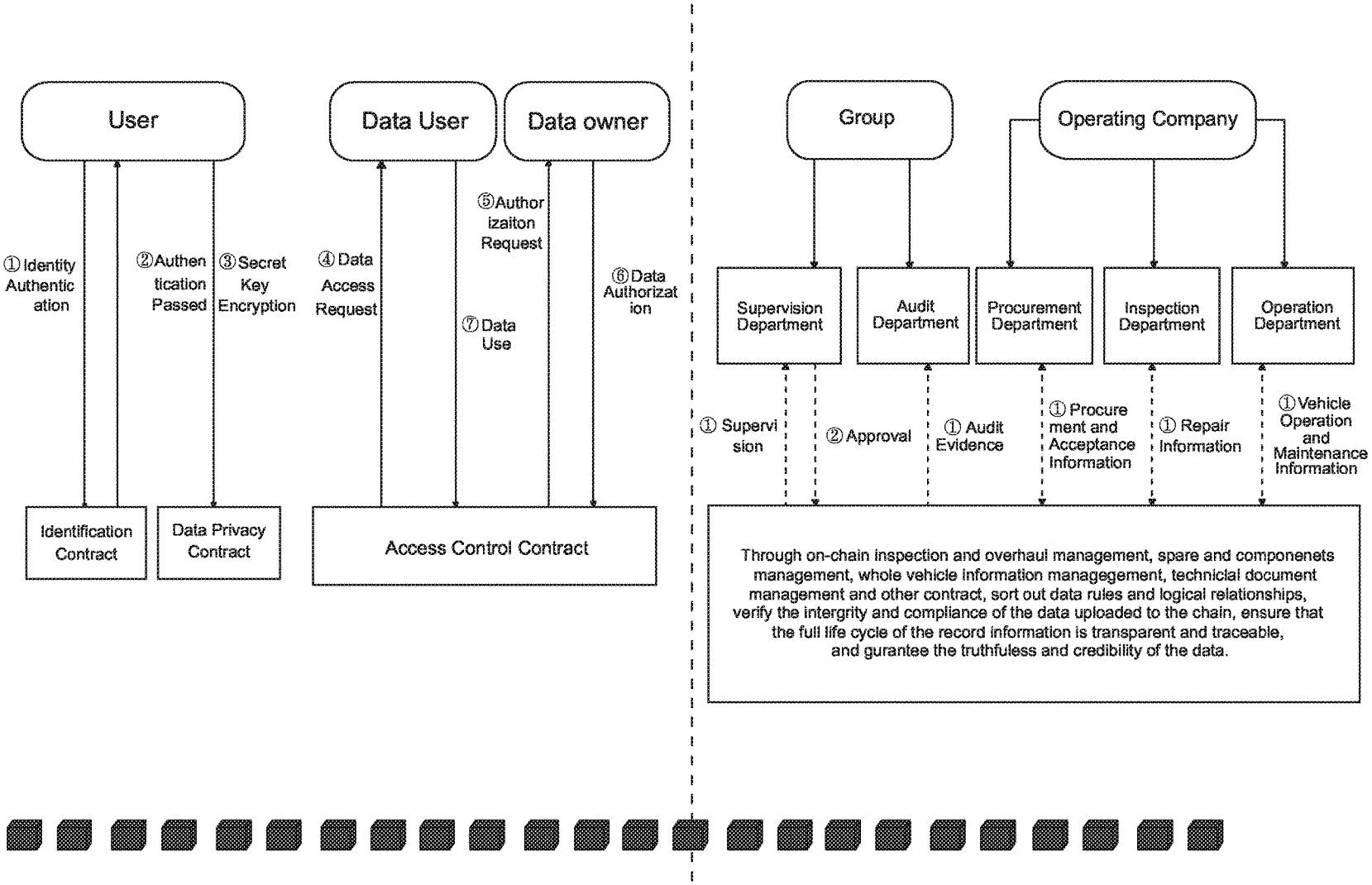
FIG. 5 is a schematic diagram of blockchain data interaction.

The electronic record contract design of the present invention is divided into two main categories: the one is based on the basic function, to carry out the development of five business-related contracts of enterprise (or system) digital identity identification, data privacy protection, access control (authority management), business data statistics, and operation process management; the other is based on the development of five business-related contracts of whole vehicle information management, status formation management, spare parts and components management, inspection and overhaul management, and technical document management. The blockchain data interaction schematic is shown in FIG. 5. The specifics are as follows:

1. Enterprise Digital Identity Class Contract: This type of contract aims to realize the functions of user registration & deregistration, digital identity creation, ID certificate issuance & cancellation, expiration of ID certificate, and renewal of certificate of the enterprise's business subsystems, so as to realize the mutual mapping between user identity and digital identity, and to provide the full life-cycle management of the enterprise's digital identity. This contract could provide the basis for business data ownership authentication, data access authorization and other functions.
2. Data Privacy Protection Contract: According to the security and controllable sharing needs of the enterprise of electronic record data reserved on the chain, this type of contract provides on-chain data privacy rule settings, data encryption authorization at multi-identity level, data authorization and authorization verification.
3. Business Data Statistics Contract: Summarize the business dimension data to be displayed in the subway cab under the management of the enterprise with this type of contract, and provide statistical results query of the data.
4. Access Control Class Contract: Realize the platform resources, authority, roles, authentication and other data on the chain with this type of contract, to ensure that the above system resources in the use of the process can be traced and not tampered with.
5. Operation Process Management Contract: With this type of contract, the key operation on the whole system could be recorded on the chain completely is uploaded to the chain for verification, so that the whole operation process recorded on the chain can be traceable and tamper-proof, to facilitate to manage the operation process of the whole system platform in a precise, digitalized and secured manner.

6. Whole Vehicle Information Management Contract: Realizes the collection and management of whole vehicle information, verification on rules and regulations, problem early warning and historical data query with the type of contract.
7. Status Information Management Contract: Realize the collection and management of equipment status information, verification on rules and regulations, problem early warning and historical data query with the type of contract.
8. Spare Parts and Components Management Contract: Realize the collection and management of spare parts and components information, verification on rules and regulations, problem early warning and historical data query with the type of contract.
9. Testing and Overhaul Management Contract: Realize the collection and management of testing and overhaul information, integrity checking, warning of cumulative number of problems with the type of contract.
10. Technical Document Management Contract: Realize the collection and management of technical document information, integrity checking with the type of contract

The invention claimed is:

1. A subway vehicle electronic record system based on blockchain technology, comprising includes:

at least one processor; and a memory storing instructions that, when executed by the at least one processor, implement:

a business view module which allows users with different functions to access a record information view comprising a user interface;

a record information maintenance module, which is used to add, modify and search data information about subway vehicle records according to different stages and different functions as well as allow personnel of responsible departments to access the maintenance function for the vehicle record information, wherein the "stages" refers to procurement, operation, renewal and reconstruction, and the "functions" refers to maintenance, repair and assets;

a statistical analysis module, in which the vehicle information could be searched, sorted out and analyzed from different management dimensions, for data statistical analysis related to a vehicle, which could be displayed in tables and charts;

a record information management module, which is for the management and maintenance of subway vehicle basic information, parts, data collection, suppliers and data security; wherein the "subway vehicle basic information" includes subway vehicle models, subway vehicle configuration, and subway vehicle grouping;

a system management module, which is for the management of organizational system, personnel, system roles, authority and log monitoring; and a blockchain foundation platform, which is for the visual deployment, upgrading, and updating of smart contracts, as well as the uploading of the record data to a blockchain and storage and verification of record data;

wherein the smart contracts on the blockchain comprise basic function contracts, the basic function contracts aiming to manage and control the permission scheme on each node in the blockchain, and including a blockchain access control contract, a digital identity management contract, and a data privacy protection contract;

wherein the blockchain access control contract realizes platform resources, authority, roles, and authentication on the chain;

wherein the digital identity management contract realizes mutual mapping between user identity and digital identity; and wherein the data privacy protection contract provides on-chain data privacy rule settings and data encryption authorization at a multi-identity level.

2. The subway vehicle electronic record system based on blockchain technology as claimed in claim 1, wherein the record information view includes a configuration view, a status view, an operation view, and an asset view;

the configuration view, which adopts the vehicle management manner of a host enterprise to uniformly standardize the names of vehicle components of different host enterprises, determine a series of unified subway companies' "label" for the vehicle component names, establish an arbitrary level of product decomposition structure to realize the refined and complete management view of the composition of the subway vehicle, as well as the substitution and alteration of the key components of the vehicle information;

the status view, which could view technical 1 documents, maintenance/conservation specifications, spare parts/parts, and current status of the operating vehicles and major components, based on the functional structure of the daily maintenance of the operating company and available authority of the corresponding subway vehicles and vehicle components data granted by different operating companies;

the operation view, which is used to warn, monitor in real time and search the history data based on the overhaul operation data, fault information data and operation information data of subway vehicle and major components published by different operating companies from the management perspective of operating companies;

the asset view, which realizes the whole process of closed-loop management for the vehicle assets from a company's subway vehicle procurement, operation, renewal and reconstruction, vehicle parts and components of the spare parts/pieces of the procurement, warehousing, collocation, change, maintenance, transfer to the renewal and reconstruction of the disposal dimension to show of spare parts/pieces of vehicle parts and components from the perspective of assets management department of a subject company.

3. The subway vehicle electronic record system based on blockchain technology as claimed in claim 1, wherein the record information includes vehicle record information, components and parts information, operation data information, and maintenance/repair information;

the vehicle record information, which realizes the record information maintenance and management of structured and non-structured data such as basic data, state information, repair and maintenance information, spare parts and components, and other structured and unstructured data of the subway vehicle by providing the vehicle record information query and maintenance function for the operating company, according to the norms and requirements of the configuration management of the subway vehicle, and realizes the change of the subway vehicle, the key components and the historical information traceability through the record version control; comprehensively displaying data information such as basic information, fault information, overhaul information, status information, transformation information, key parts information, and equipment data of subway vehicles;

the parts information, which realizes the query and maintenance of the inventory, storage unit, quantity and other information of the spare parts and components, and replacement parts of the vehicle parts, effectively utilizing the life of the parts and reducing the inventory level, and at the same time realize the full life cycle management of the key parts, as well as realizes the reverse tracing of the information in the stages of overhauling, operation, production and design by serial number in case of a problem;

the operation data information, which realizes the reporting and query function of the operation status log information of the subway vehicle and key components, control system and train-to-ground communication system and other information;

the maintenance/repair information, which realizes the reporting and query of operation data of subway vehicles and key components.

4. The subway vehicle electronic record system based on blockchain technology as claimed in claim 1, wherein the data queried and analyzed by the statistical analysis module include an asset ledger, a vehicle ledger, a parts ledger, and a statistical statement.

5. The subway vehicle electronic record system based on blockchain technology as claimed in claim 1, wherein the record information management module is used for model management, configuration management, vehicle management, grouping management, parts management, supplier management, data collection management, and information setting;

the model management, which covers all models of train information, including train models, names and other key information, and realizes functions such as creation, updating and deletion of models;

the configuration management, which realizes the configuration directory template creation, node creation, label definition, node information project configuration and other management and maintenance functions of subway vehicle, provides the basic directory framework for the information maintenance of the vehicle configuration in the later stage, as well as establishes metadata, data definitions, constrains, data relations for vehicle and provide management function for data, according to the subway vehicle configuration management specification;

the vehicle management, which establishes management configuration and functional configuration for the newly purchased subway vehicles and existing subway vehicles, and defines the vehicle configuration hierarchy, attributable range of hierarchical parts and other functions, according to the subway vehicle configuration management specification;

the grouping management, realizes the detailed information related to all line assignments of the company, which can be associated with multiple conditions such as line assignment, operating company, model, group number, telegraph number, assignment type, assignment date, and displays the maintenance and management functions of line assignments, the current state of the vehicle group, the form of the grouping, and the information of the manufacturing plant;

the parts management, which is used for the construction of parts of the location, type, function and other multi-dimensional management model, and the attributes information in the defining part provides a visual display of the full life cycle of a single piece of maintenance template for the query and maintenance of vehicle record information;

the supplier management, which is for management and maintenance of subway vehicle host manufacturers, parts suppliers and operation and maintenance manufacturers information;

the data collection management, which is for the collection, cleaning, arrangement, management and maintenance of data related to subway vehicle;

the information setting, which is for the management of vehicle maintenance/repair, routing inspection, testing and other types of code table information, as well as maintenance of subway vehicle fault type and fault code relationship.

6. The subway vehicle electronic record system based on blockchain technology as claimed in claim 1, wherein The data uploading to the blockchain covers the full life cycle of the subway vehicle project establishment, design liaison, supervision and manufacture, check and acceptance, operation, and scrapping, and according to the type of data uploaded to the blockchain, includes the basic vehicle configuration data, vehicle state information, operation and maintenance data, and relevant documents;

On-chain contracts include basic function contracts and business contracts, in which the basic function contracts aim to manage and control the permission scheme on each node in the blockchain, user login and other basic functions; the business contracts involve data that need to be uploaded to the blockchain in different business phases, including the contract for registration of project establishment, contract for uploading of project documents, contract for analysis of vehicle configuration, contract for updating of design liaison data, contract for updating supervision on manufacture data, contract for uploading supervision on manufacture documents, and contract for registering leave-factory check and acceptance, the data uploaded to blockchain is selected to be uploaded at different business stages, including project establishment, design liaison, supervision and manufacture, check and acceptance, operation, and scrapping.

* * * * *